US005151158A

United States Patent [19]

Bowen et al.

[11] Patent Number: 5,151,158

[45] Date of Patent: Sep. 29, 1992

[54] THERMAL CRACKING FURNACE

[75] Inventors: Colin P. Bowen, Houston; John R. Brewer, Katy, both of Tex.

[73] Assignee: Stone & Webster Engineering Corporation, Boston, Mass.

[21] Appl. No.: 730,560

[22] Filed: Jul. 16, 1991

[51] Int. Cl.[5] ..... C10G 9/20

[52] U.S. Cl. ..... 196/110; 196/116; 422/197; 422/204

[58] Field of Search ..... 196/110, 116; 422/196, 422/197, 204

[56] References Cited

U.S. PATENT DOCUMENTS

| | | | |
|---|---|---|---|
| 2,151,386 | 3/1939 | De Florez | 196/110 |
| 2,653,903 | 9/1953 | Kilpatrick . | |
| 2,917,564 | 12/1959 | Pollock . | |
| 3,230,052 | 1/1966 | Lee et al. . | |
| 3,407,789 | 10/1968 | Hallee et al. . | |
| 3,579,601 | 5/1971 | Kivlen . | |
| 3,910,768 | 10/1975 | Woebcke et al. . | |
| 4,008,128 | 2/1977 | Dorner | 196/110 |
| 4,021,501 | 5/1977 | Dyer et al. . | |
| 4,045,211 | 8/1977 | Powers . | |
| 4,086,960 | 5/1978 | Haynes . | |
| 4,361,478 | 11/1982 | Gengler et al. . | |
| 4,492,624 | 1/1985 | Johnson et al. . | |
| 4,732,740 | 3/1988 | Woebcke et al. . | |
| 4,792,436 | 12/1988 | Tsai | 196/110 |

FOREIGN PATENT DOCUMENTS

| | | | |
|---|---|---|---|
| 298624 | 1/1989 | European Pat. Off. | 422/197 |
| 1313864 | 5/1987 | U.S.S.R. . | |
| 1393841 | 5/1988 | U.S.S.R. . | |

*Primary Examiner*—Joye L. Woodard

*Attorney, Agent, or Firm*—Hedman, Gibson & Costigan

[57] ABSTRACT

A thermal cracking furnace comprising horizontally disposed and vertically disposed radiant tube sections.

7 Claims, 2 Drawing Sheets

THERMAL CRACKING FURNACE

FIELD OF THE INVENTION

This invention relates to furnaces for thermally cracking hydrocarbons. More particularly, the invention relates to a furnace and process for cracking hydrocarbons wherein firing is entirely by floor burners and in which coil fouling due to coke formation is minimized.

BACKGROUND OF THE INVENTION

It has long been known to thermally crack hydrocarbon to produce olefins and other lighter hydrocarbon products.

Typically, a thermal cracking furnace is comprised of a firebox and a plurality of coils that extend through the firebox. A hydrocarbon feedstock is introduced into the cracking furnace and elevated to high temperatures, e.g. 1600° F. and quenched to a reaction temperature to provide a yield of cracked products. However, the nature of the thermal cracking process causes coke and tar to form along with the desired products. From the beginning of the practice of thermal cracking, fouling of the coils resulting from coke and tar generation has been a serious problem. When the coils are fouled by coke and tar the furnace must be taken out of service to clean or replace the tubes.

Light hydrocarbons such as ethane are a common and often preferred feedstock. However the high heat of cracking of light hydrocarbon feedstocks poses design constraints and the fouling characteristics of coke from the cracking of the light hydrocarbon feedstocks is particularly troublesome.

Furthermore, as the thermal cracking technology advanced, a trend to high severity cracking occurred to achieve either improved yields or increased selectivity to the desired ultimate product. As a result, thermal cracking furnaces having small diameter, short length coils and a concentration of radiant burners along the furnace walls facing the coils were developed for high severity cracking to attain higher olefin selectivity. Practice has shown that at high severity coking problems become more pronounced.

A further development was the application of floor firing of thermal cracking furnaces. Although many benefits attend floor firing, experience indicated that deleterious localized coking often resulted from floor firing.

The conventional wisdom now prevailing in thermal cracking is that short residence time, high severity cracking will produce the highest selectivity and olefin yield. However, under high severity cracking conditions, particulary in conjunction with total floor firing, the coking problems increase and the operating run length consequently decreases causing shorter effective operational availability and curtailed equipment life.

SUMMARY OF THE INVENTION

Contrary to the conventional wisdom, it has been found that maximization of olefin output defined as the product of average cracking cycle yield and average furnace availability can be achieved over the long-run by a furnace and process that uses the maximum available radiant heat.

It is an object of the present invention to produce a furnace that maximizes the use of available radiant heat and minimizes coil fouling resulting from coke and tar formation during thermal cracking.

It is another object of the present invention to provide a furnace that can be fired exclusively by furnace floor burners.

It is a further object of the present invention to provide a furnace and process that relies on radiant furnace coils that are mounted both horizontally and vertically in order to maximize available radiant firebox volume.

To these ends, a furnace has been developed with a radiant zone fired by floor burners, an offset convection zone and a horizontal breeching zone extending between the radiant zone and the convection zone. Horizontally disposed convection coils extend through the convection zone to a common external manifold from which the preheated feedstock is distributed to the downstream radiant coils. The radiant coil assembly comprises a horizontal section extending from the common inlet manifold through the horizontal breeching zone and a vertical U-shaped coil section mounted in the radiant zone that terminates outside of the firebox at the connection to the quench exchanger system.

The process proceeds by delivering hydrocarbon feedstock to the convection coils wherein the feedstock is heated, delivering the heated feedstock to the common manifold for equilibration of temperature and pressure and thereafter through the radiant coils for high temperature cracking.

The heat generated by the radiant floor burners provides radiant heat in the radiant sections of the furnace while the combustion flue gases provide the convection heat for the convection tubes. In the breeching section of the furnace heat is provided by both radiant and convective heat transfer.

DESCRIPTION OF THE DRAWINGS

The invention will be better understood when considered with the following drawings wherein.

DESCRIPTION OF THE PREFERRED EMBODIMENT

Figure 1:
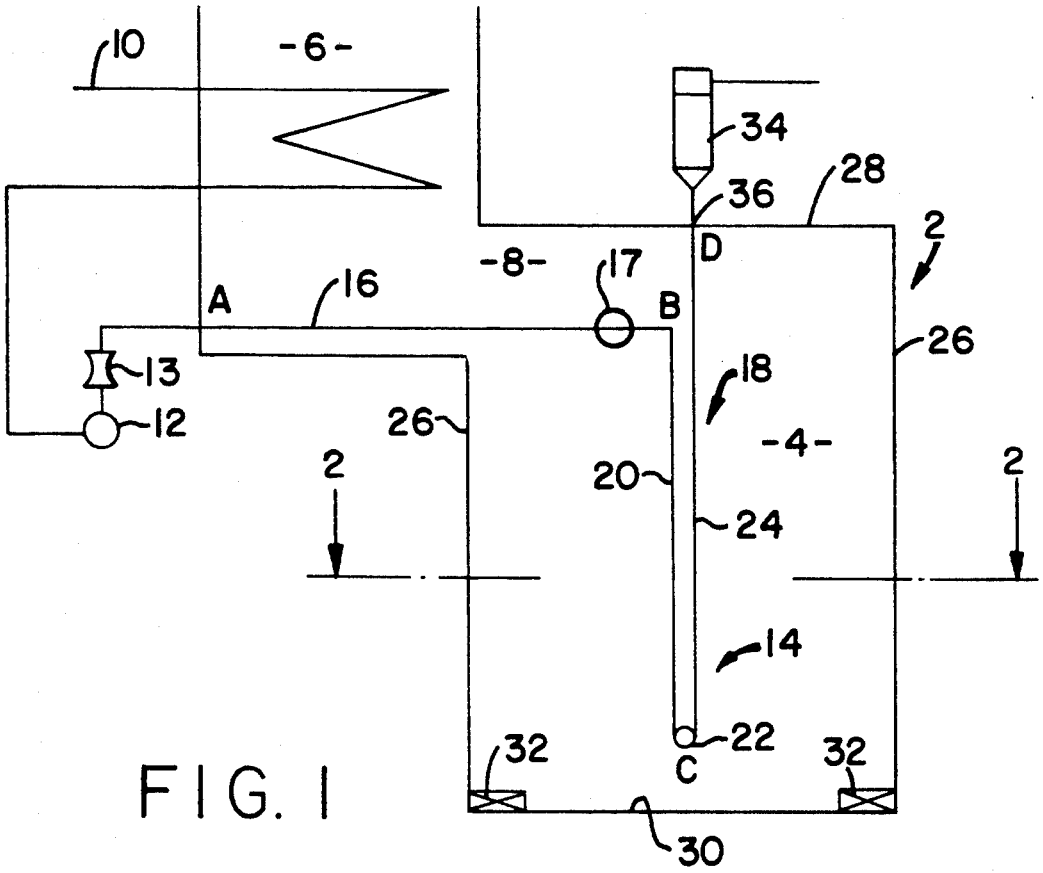
FIG. 1 is an elevational view of the furnace of the invention.

The furnace of the present invention is a furnace for thermally cracking hydrocarbon feedstock.

The furnace 2 is comprised of a radiant zone or section 4, a convection zone or section 6 offset from the radiant zone or section 4 and a horizontally disposed upper radiant zone or breeching zone 8 connecting the radiant zone 4 with the convection zone 6.

As best seen in FIG. 1, a plurality of convection coils 10 extend horizontally through the convection zone 6 and terminate in a common manifold 12. Radiant coils 14 comprised of a horizontal section 16 and a connected downstream vertical section 18 extend from the common manifold 12 through the horizontal breeching zone 8 and the radiant zone 6. The vertical downstream sections 18 of the radiant coils 14 are configured in a U-shape with an upstream section 20, a U-bend 22 and a downstream section 24.

Figure 2:
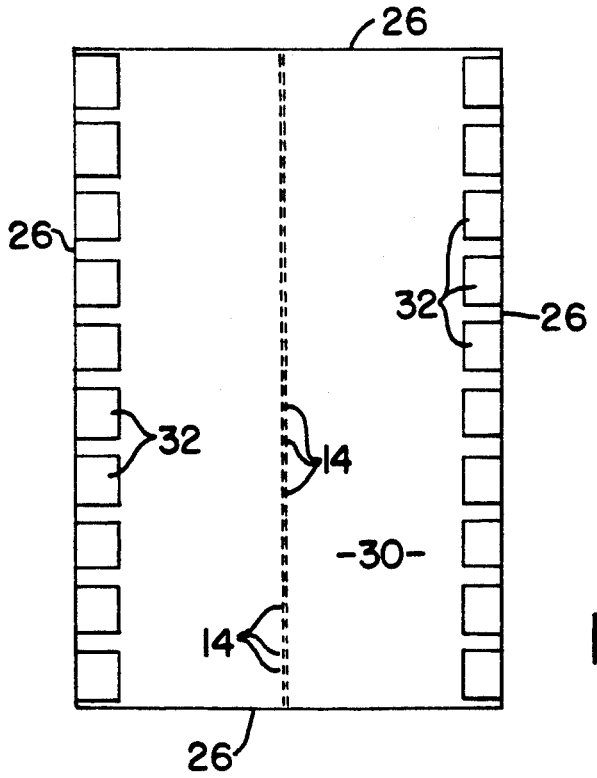
FIG. 2 is a plan view taken through line 2—2 of FIG. 1.

The furnace 2 has sidewalls 26, a roof 28 and a floor 30. The furnace is fired entirely by floor burners 32, best seen in FIG. 2, that provide radiant heat to the vertically disposed sections 18 of the radiant coils 14 and the horizontally disposed coil section 16 in the breeching zone 8. The flue gases generated by the floor burners 32 provide convection heat for the convection section 6 of the furnace 2 and contribute a modest amount of convection heat to the horizontal radiant coil sections 16 of the radiant coils 14.

Quench exchangers 34 are provided to quench the effluent produced by thermally cracking the hydrocarbon feedstock in the furnace 2. A quench exchanger 34 (individual or common) is located immediately downstream of the outlet 36 of each radiant coil 14.

The radiant coils 14 are comprised of differentially sized tubes. Practice has shown that the furnace 2 will perform well for long periods of time without the need to decoke the tubes when the horizontally disposed section 16 of the radiant coils 14 is of the smallest internal diameter, the upstream vertical coil section 22 is of an intermediate internal diameter and the vertical coil section 24 is of the largest internal diameter. Illustratively, the horizontally disposed sections 16 of the radiant coils 14 are 1.2 inches to 1.5 inches internal diameter; the vertical coil sections 20 are 1.5 inches to 2.5 inches internal diameter and the vertical coil sections 24 are 2.0 inches to 3.0 inches internal diameter.

Figure 3:
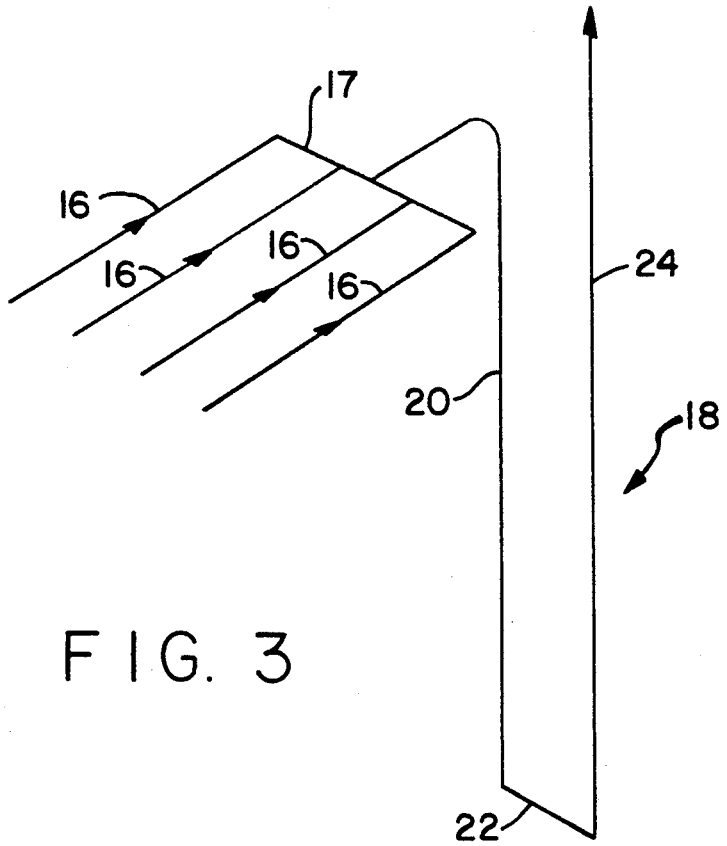
FIG. 3 is a perspective view of the furnace coils seen in FIG. 1.

One embodiment of the radiant coils 14 is seen in FIG. 3 wherein four horizontally disposed radiant coil sections 16 terminate in a connection fitting 17 and from which a single upstream vertical coil section 20 extends and continues as a single downstream vertical coil section 24.

Figure 4:
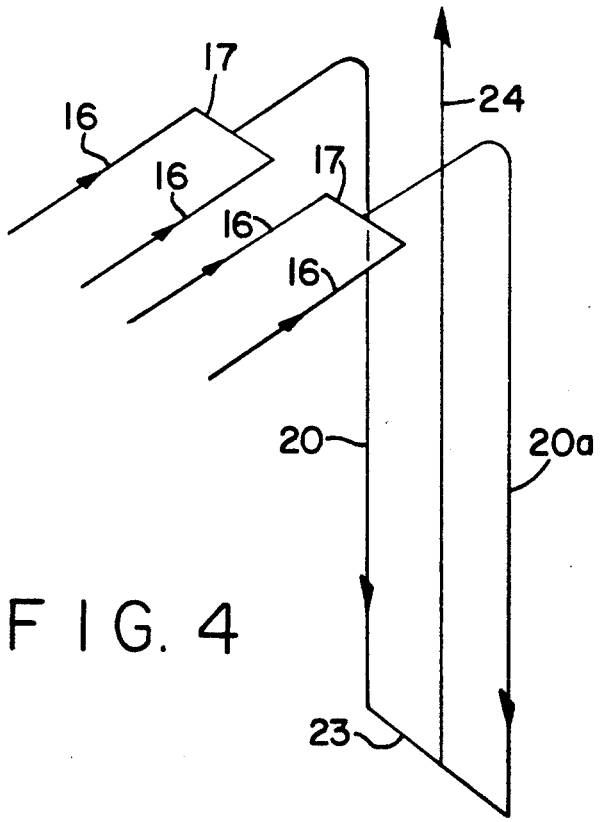
FIG. 4 is a perspective view of a variation of the furnace coils seen in FIG. 1.

An alternative embodiment is seen in FIG. 4 wherein the radiant coils 14 are comprised of two sets of two horizontally disposed radiant coil sections 16 that terminate in two connection fittings 17 from which two upstream vertical radiant coil sections 20 and **20*a* respectively extend and terminate in a connection fitting 23. A single downstream vertical radiant coil section 24 extends from the connection fitting 23 to a quench exchanger 34**.

The process of the present invention proceeds by delivering hydrocarbon feedstock such as ethane, naphtha etc. to the inlet of the convection coils 10. The feedstock is heated to temperatures of 1000° F. to 1300° F. in the convection zone 6. After delivering the feedstock from all of the convection coils 10 to the manifold 12 to equalize the temperature and pressure, the hydrocarbon feed is elevated in temperature in the horizontal radiant breeching zone 8 to temperatures of 1300° F. to 1450° F. at a residence time of 0.05 sec. to 0.075 sec. Thereafter, the hydrocarbon feedstock is heated to the final cracking temperature of 1500° F. to 1650° F. in the vertical section 18 of the radiant coils at a residence time of 0.175 sec. to 0.25 sec.

The heat flux produced in the furnace is 12000 BTU/Hr.Ft.$^2$ to 35000 BTU/Hr.Ft.$^2$. Radiant heat of 1.00 MM BTU/Hr. per coil to 1.25 MM BTU/Hr. per coil is provided in the radiant zone 4 and 0.45 MM BTU/Hr. per coil to 0.55 MM BTU/Hr. per coil in the horizontal radiant breeching zone 8. The combustion gases reach the convection zone 6 at a temperature of 1900° F. to 2000° F.

The following table illustrates the projected conditions after forty days of continuous operation of the furnace 2 of the invention wherein dimensions from the coil inlet through the end of the horizontal radiant coil section 16 are 1.3 inches inside diameter and four coils of thirteen feet length and the dimensions from the connection of the horizontal radiant coil section 16 to the coil outlet 36 are 2.5 inches inside diameter and one coil of eighty two feet length.

The operating conditions for the run are 1100 lb. ethane feedstock/Hr. per coil, 12 psig coil outlet pressure; 0.3 lb. steam/lb. hydrocarbon; 65% conversion. The maximum tube metal temperature occurs between points C and D and is 2015° F.

TABLE 1

| LOCATION | COIL INLET A | END OF HORIZONTAL SECTION B | BOTTOM OF RETURN BEND C | COIL OUTLET D |
|---|---|---|---|---|
| Process Temp. °F. | 1300 | 1454 | 1522 | 1608 |
| Tube Metal Temp. (TMT) °F. | 1658 | 1790 | 1909 | 1901 |
| Bridge Wall Temp. (BWT) (Flue Gas Temp.) °F. | 1965 | 2066 | 2155 | 2065 |

We claim:

1. A thermal cracking furnace comprising:

a radiant section;

a convection section offset from the radiant section;

a horizontally disposed breeching section extending between the radiant section and the convection section;

a heating means comprising an array of floor burners in the radiant section; and a plurality of radiant coils extending through the horizontally disposed breeching section and the radiant section, said radiant coils being comprised of a horizontal radiant coil section extending through the horizontal breeching section and vertical coil sections extending through the radiant section wherein the radiant coils of the horizontal breeching section have an internal cross-sectional diameter smaller than the internal cross-sectional diameter of the coils of the vertical coil sections of the radiant coils and the vertical coil sections of the radiant coils are comprised of an upstream and a downstream section wherein the radiant coils in the upstream section of the vertical coil sections have a larger internal cross-sectional diameter than the coils of the horizontal section of the radiant coils and the radiant coils in the downstream section of the vertical sections of the radiant coils have a larger internal cross-sectional diameter than the coils of the upstream section of the vertical section of the radiant coils.

2. A thermal cracking furnace as in claim 1 wherein the heating means consist essentially of the array of floor burners.

3. A thermal cracking furnace as in claim 1 further comprising a plurality of convection coils in the convection section and a common manifold upstream of the radiant section into which the convection coils extend and wherein the plurality of radiant coils extend from the common manifold.

4. A thermal cracking furnace as in claim 3 wherein each radiant coil of the plurality of radiant coils terminates in an outlet and further comprising a quench exchanger at the outlet of each radiant coil.

5. A thermal cracking furnace as in claim 1, wherein the internal cross-sectional diameter of the horizontal section of the radiant coils is 1.2 inches to 1.5 inches; the internal cross-sectional diameter of the upstream section of the vertical section of the radiant coils is 1.5 inches to 2.5 inches and the internal cross-sectional diameter of the downstream section of the vertical section of the vertical coils is 2.0 inches to 3.0 inches.

6. A thermal cracking furnace as in claim 1 further comprising a connection fitting into which a plurality of the horizontal radiant coils extend and wherein the upstream vertical coil section comprises a single downflow coil extending from the connection fitting.

7. A thermal cracking furnace as in claim 1 further comprising a plurality of first connection fittings into which a plurality of the horizontal radiant coils extend; at least one of said downflow upstream radiant coils extending from each of the plurality of first connection fittings, a second connection fitting into which each of the downflow upstream radiant coils extend and a single one of said downstream vertical upflow coils extending from the second connection fitting.

* * * * *